US007694975B1

(12) United States Patent
Darby

(10) Patent No.: US 7,694,975 B1
(45) Date of Patent: Apr. 13, 2010

(54) TOYS OR GAMES USING A LAUNCHING DEVICE AND FOAM BLOCKS

(76) Inventor: Ronald Alton Darby, 44-401 Kaneohe Bay Dr., Kaneohe, HI (US) 96744

( * ) Notice: Subject to any disclaimer, the term of this patent is extended or adjusted under 35 U.S.C. 154(b) by 0 days.

(21) Appl. No.: 12/154,233

(22) Filed: May 20, 2008

(51) Int. Cl.
*A63F 9/00* (2006.01)

(52) U.S. Cl. ..... 273/450

(58) Field of Classification Search ..... 273/440, 273/445, 446, 449, 450, 459
See application file for complete search history.

(56) References Cited

U.S. PATENT DOCUMENTS

| | | | | |
|---|---|---|---|---|
| 3,630,520 | A | 12/1971 | Cooper | |
| 3,730,519 | A * | 5/1973 | Garrity et al. | 273/459 |
| 3,994,492 | A * | 11/1976 | Breslow | 273/459 |
| 4,324,065 | A * | 4/1982 | Cooper | 446/337 |
| 4,932,655 | A * | 6/1990 | Kurita | 273/450 |
| 5,193,808 | A * | 3/1993 | Takeshi | 273/138.1 |
| 5,216,832 | A * | 6/1993 | Darby | 43/81 |
| 5,240,260 | A * | 8/1993 | Strongin | 273/445 |
| 5,480,159 | A * | 1/1996 | Alsip | 273/450 |
| 5,797,385 | A | 8/1998 | Thai | |
| 5,954,340 | A * | 9/1999 | Tedesco | 273/450 |
| 5,988,152 | A | 11/1999 | Halter et al. | |
| 2006/0255545 | A1 * | 11/2006 | Giglia | 273/449 |

* cited by examiner

*Primary Examiner*—Raleigh W. Chiu

(57) ABSTRACT

The invention, an apparatus and foam blocks for toys and an adjunct for games, consists of a spring-loaded platform acting as the launcher used in conjunction with foam blocks. The spring-loaded platform consists of two plastic parts butted together using the force from a cord to form a stable platform when unloaded. Light weight foam blocks are placed in specified locations on the platform by the players one at a time until the weight of the blocks (or the slight impulse of a foam block being placed by a nervous player) causes the platform to collapse very rapidly. The light weight foam blocks are thrown around for several feet in random directions from the platform. The event amounts to a harmless explosion introducing a high level of suspense, surprise and a wow-factor when used solely as a toy or when used as an adjunct to a card or board game.

5 Claims, 2 Drawing Sheets

TOYS OR GAMES USING A LAUNCHING DEVICE AND FOAM BLOCKS

CROSS-REFERENCE TO RELATED APPLICATIONS

This application uses a similar basic concept, that is a spring-loaded collapsing platform device for a different purpose as disclosed in my U.S. patent "Animal Chasing Device", U.S. Pat. No. 5,216,832 granted Jun. 6, 1993.

FEDERALLY SPONSORED RESEARCH

None

SEQUENCE LISTING

None

BACKGROUND

This invention relates to toys and games and more particularly to that class of toys involving a spring-loaded launching apparatus actuated by the mass or impulse of objects that are manually placed on the apparatus until it very rapidly and harmlessly propels the objects randomly away.

In recent years toy guns which propel harmless projectiles have become popular as shown in U.S. Pat. No. 5,797,385 to Thai (1998) and U.S. Pat. No. 5,988,152 to Halter, et al (1999). Many parents currently do not want their children to play with toy guns and possibly develop an insensitivity to the seriousness of real gun use.

An earlier invention, U.S. Pat. No. 3,630,520 to Copper (1971), had goals similar to this patent in that it could be used solely as a toy or could be used as a novel game. Also the referenced patent was based on the users placing weights on a spring-loaded apparatus (a toy mule figure) causing tension, suspense and surprise in the players when nervously loading the apparatus. However the climax of having the mule rear-up and drop-off his 'equipment' (weights placed by the players) within a few inches is very, very minuscule compared to the "explosion" of harmless foam blocks flying many feet in this invention. Also the relatively complicated system of metal springs, linkage members, latches, cams, detent pawls used the referenced patent has a higher probability of rusting or otherwise failing compared to the three moving non-metallic parts in the new invention. Another consideration is that in the referenced invention the small plastic equipment parts dropped around the mule could harm small children if swallowed while the large foam blocks in the new invention are safe.

My related U.S. Pat. No. 5,216,832 grated Jun. 8, 1993 uses a similar basic concept, that is an apparatus with a spring-loaded collapsing platform for the purpose of harmlessly chasing animals from areas where they are not wanted. Originally they were used to chase wild birds off moored boats and from lanais, porches and decks. Presently they are also used to harmlessly chase domestic cats from kitchen counter tops, furniture, Christmas trees, etc. The apparatus in this patent is similar to that described above, but for using it in toys and games slight modifications are shown including a single elastic cord in a recessed groove and retained by keyholes in the rigid body members and a different type of hinge between the two rigid body members.

The invention relates to toys for younger children or as an adjunct to card and board games for all ages. The new apparatus introduces an element of surprise, suspense and a wow factor when used solely as a toy or when used as an adjunct to a card or board game, it enhances the playing of the game.

In conclusion, as far as I am aware, no existing toy or adjunct for card or board games have an apparatus for safely introducing reliability, suspense, surprise and a wow-factor compared to the new apparatus described here.

SUMMARY

The invention, an apparatus for toys and an adjunct for games, consists of a spring-loaded platform acting as the launcher used in conjunction with foam blocks. The spring-loaded platform consists of two plastic parts butted together using the force from a elastic cord to form a stable platform when unloaded. Light weight foam blocks are placed in specified locations on the platform by the players one at a time until the weight of the blocks (or the slight impulse of a foam block being placed by a nervous player) causes the platform to collapse very rapidly. The light weight foam blocks are thrown around for several feet in random directions from the platform. The event amounts to a harmless explosion introducing a high level of suspense, surprise and a wow-factor when used solely as a toy or when used as an adjunct to a card or board game.

DRAWINGS

REFERENCE NUMERALS

Figure 1:
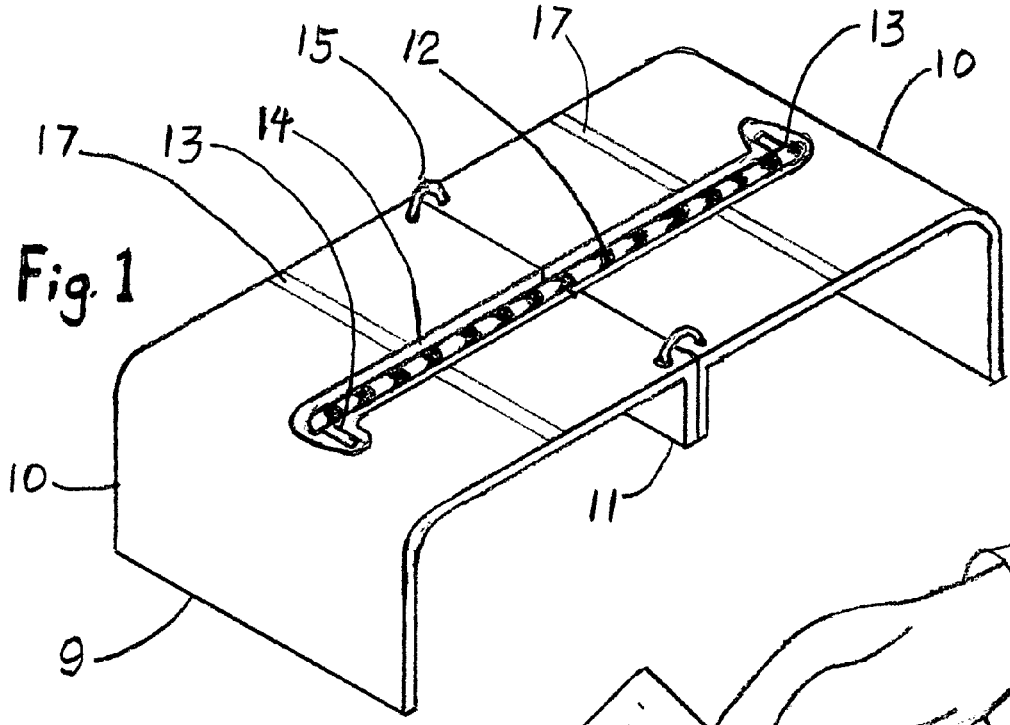
FIG. 1 is a perspective view of the launching apparatus in the set position.

9 launching apparatus
10 rigid body member
11 butting component
12 elastic cord
13 keyhole
14 groove for elastic cord
15 hinge
16 foam block
17 mark for placing blocks
18 player's hand

DETAILED DESCRIPTION

FIG. 1 is a perspective view of the launching apparatus 9 in the set position with two rigid body members 10 held together by the force from a elastic cord 12 pressing together the two butting components 11 of the rigid body members. 10. The elastic cord 12 is attached to the rigid body members 10 by squeezing the ends of the elastic cord 12 into the narrow portion of a keyhole 13 in each rigid body member 10. The elastic cord 12 is recessed in grooves 14 in each rigid body member 10 which also act as stiffeners for the rigid body members 10. A metal ring or a small loop made of cord serves as an optional hinge 15 between the two body members 10 which makes the setting of the launching apparatus 9 easier.

Figure 2:
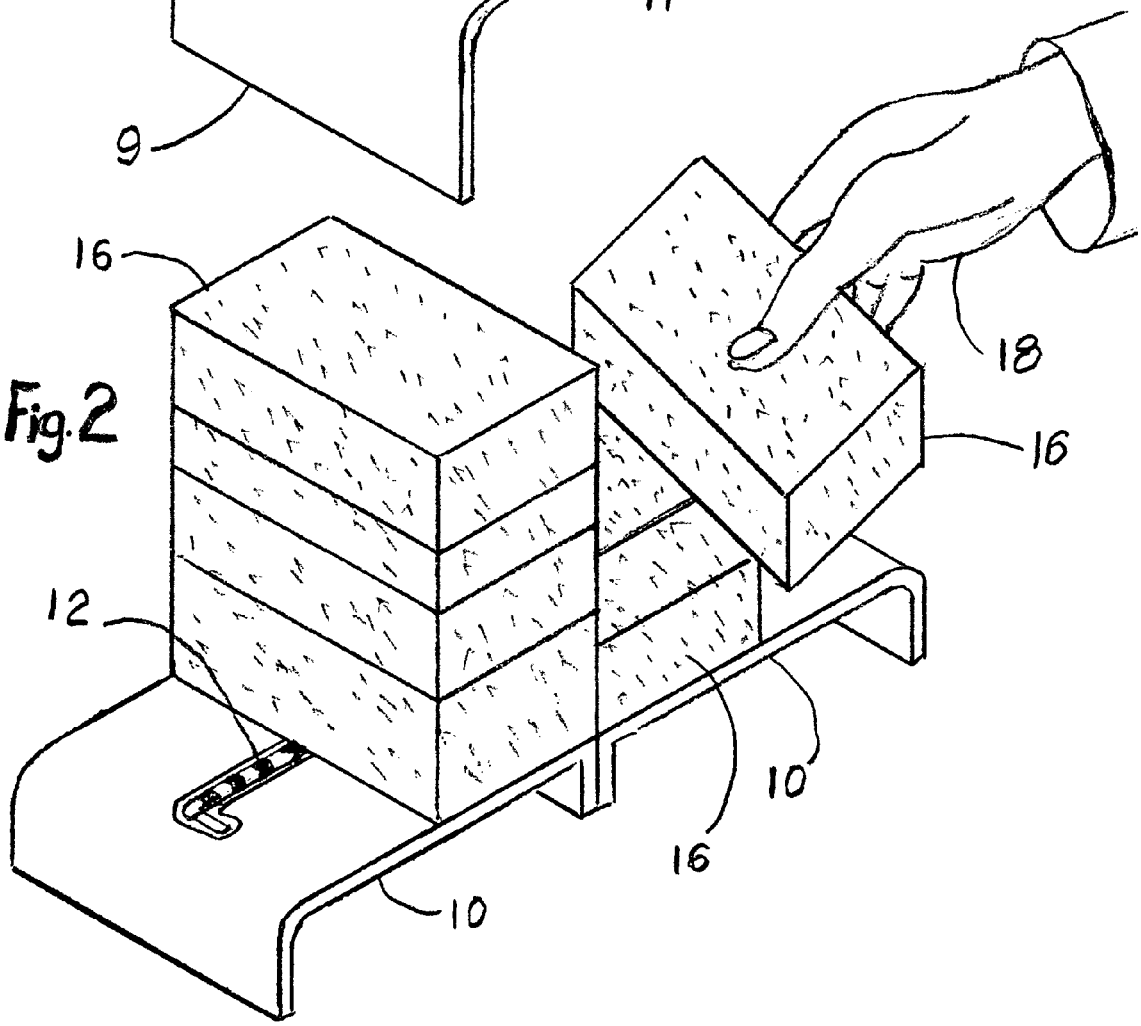
FIG. 2 is a perspective view of the launching apparatus in the set position with foam blocks stacked on it typically as in a game.

FIG. 2 is a perspective view of the launching apparatus 9 in the set position with foam blocks 16 stacked on it typically as in a game. The light-weight foam blocks 16 may be of any shape including, but not restricted to, rectangular solids, triangular solids, blocks with curved surfaces, blocks characterized in the shape of animals, appliances, bombs, aircraft, automobiles, etc. Each player must stack his bottom foam block 16 within the space defined by his end of the rigid body member 10 at the butting component 11 below and his mark for placing blocks 17. A player's hand 18 is placing a foam block 16 on his stack of blocks 16.

Figure 3:
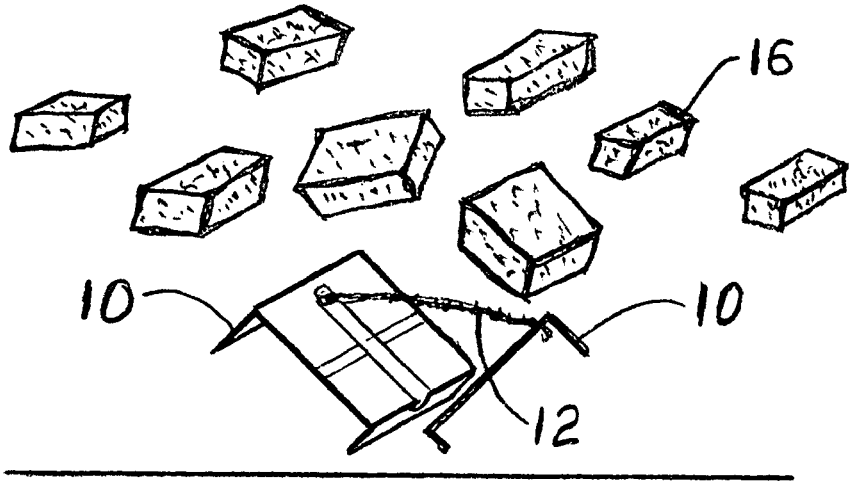
FIG. 3 is a perspective view of the launching apparatus in the exploding mode with foam blocks randomly flying.

FIG. 3 is a perspective view of the launching apparatus 9 in the exploding mode with the foam blocks 16 flying randomly around.

Figure 4:
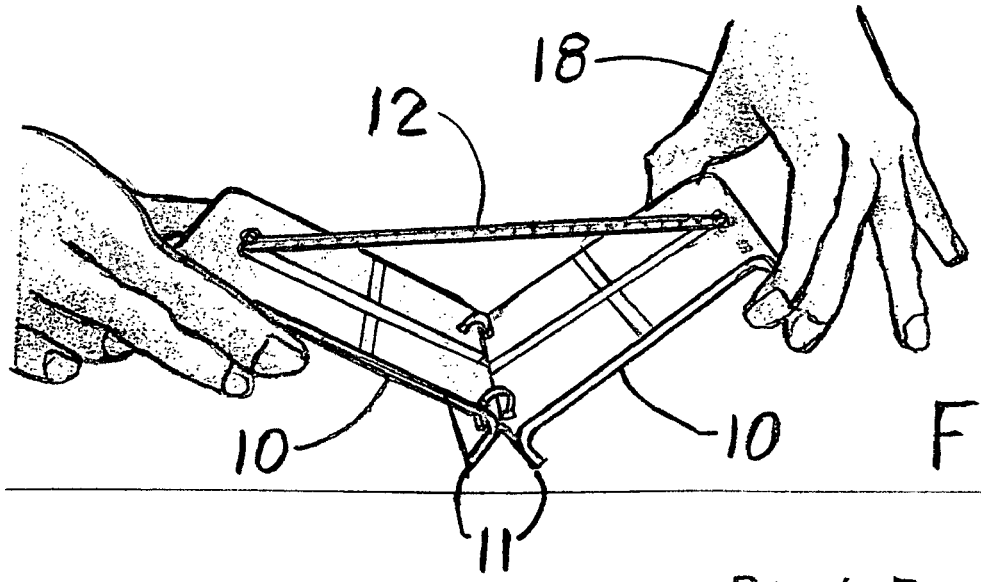
FIG. 4 is a perspective view of the launching apparatus being reset after exploding.

FIG. 4 is a perspective view of the launching apparatus 9 being reset after exploding wherein a player's hands 18 are grasping the two rigid body members 10 and are stretching the elastic cord 12 while the upper edges of the two butting components 11 are in contact and serve as the pivot line.

Figure 5:
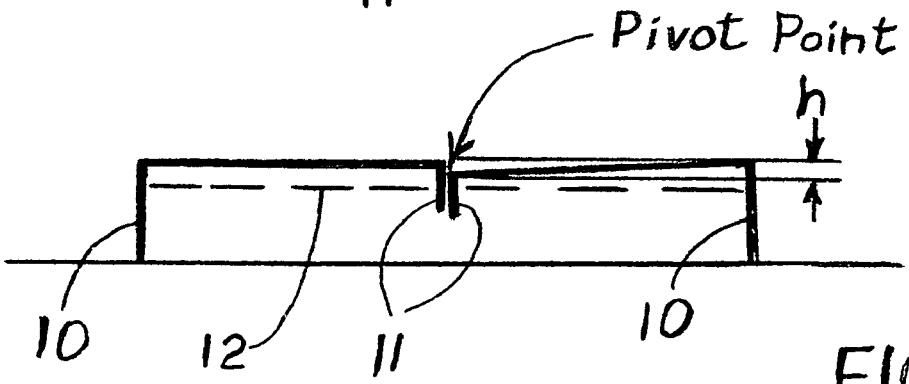
FIG. 5 is a schematic side view of the launching apparatus in a set condition.

FIG. 5 shows the launching apparatus 9 in a set position wherein an equilibrium condition exists by virtue of the force from the stretched bungee cord 12 pressing together the two butting components 11 of the rigid body members 10. The distance "h" between the two upper edges of the butting components 11 determine the pivot line and the sensitivity to actuation of the device to forces applied perpendicular to the top surfaces of the rigid body members 10.

The sensitivity of the apparatus 9 can be adjusted when resetting the apparatus 9 as shown in FIG. 4. When the two top edges of the butting components 11 are butted together with h=0, the apparatus 9 is least sensitive, that is, it will carry the weight of the greatest number number of blocks 16. without exploding. When one upper edge of a butting component 11 is butted slightly lower than the other as shown in FIG. 5, say 1/16 inch lower so h=1/16 inch, the apparatus 9 is most sensitive, that is, it will carry the weight of the least number number of blocks 16.

Operation

Use of this apparatus 9 and foam blocks 16 falls into four categories:

1) Use as a toy wherein the users, usually smaller children, enjoy the suspense while placing the foam blocks 16 in unlimited configurations on the launcher 9 consummating in explosions of foam blocks 16 flying all over as shown in FIG. 3.

2) Use as a simple game wherein two players have the goal of placing the most foam blocks 16 on the launcher 9 and acquiring the most points before the explosion. Foam blocks 16 which are lighter in weight or relatively big and flat making it easier to add more blocks 16 in a stable stack are worth less points. Foam blocks 16 which are heavier or shaped so that it is harder to build a stable stack above them are worth more points. The blocks 16 may be of different colors and have their point value written on them in large letters may allow some small children to readily keep score as the game proceeds. This game improves a child's number identification ability, mathematical capabilities, fine-motor control as well as decision-making ability while dealing with suspense.

3) The launching apparatus 9 and foam blocks 16 could be customized to be used with existing board and card games such as Chess, Checkers, Go Fish, Pinochle, and Hearts as well as other games with a little creativity. In this case it actually amounts to a game played along with, and in conjunction with, the normal board game. Every time you win a significant event in the board or card game, you must place a foam block 16 on your side of the launching apparatus 9. The goal is to make the most points from your foam blocks 16 won based on your winnings from the card or board game without collapsing the launching apparatus 9 and throwing the foam blocks 16 around. It requires risk taking judgments involving the laws of physics in block stacking, such as gravitational forces, moments, creep (gradual shifting), impulse and momentum as well as fine motor control probably not required in the card or board game. It can amount to an equalizer when one player is much more expert in playing that particular card or board game and the other player is more adept with the launching apparatus/block 9/16 game.

4) Use of this launching apparatus 9 and foam blocks 16 in the design of the rules and operations for new board games will introduce an exciting new level of surprise and suspense to the players, particularly for games using themes involving short-term gains versus sustainability, such as games based on the stock market, developers and environmental concerns, global warming, weapon development, etc. As above, for small risks the blocks 16 are light in weight and relatively big or flat making it easier to add more blocks 16 in a stable stack and are worth less points. For large risks, the blocks 16 are heavier or shaped so that it is harder to build a stable stack above them and worth more points. The goal is to make the most points from your foam blocks 16 based on your winnings without collapsing the launching apparatus 9 and throwing the foam blocks 16 around. Thus the goals are to win biggest before the stock market collapses, global meltdown occurs, or nuclear holocaust occurs.

Examples of other possible rules to consider in the above launching apparatus/block 9/16 games are:

a) If while placing a block 16 on the launching apparatus 9 you cause your stack of blocks 16 to explode throwing the foam blocks 16 all around, you get no points while your partner keeps points for his blocks 16 that were on the launching apparatus 9 before the explosion. The launching apparatus 9 is reset and a new set begins.

b) If while placing a block 16 on the launching apparatus 9 you cause all or some of your blocks 16 to fall off the launching apparatus 9 without causing the launching apparatus 9 to explode, the game continues, but you loose the blocks 16 and the points for the blocks 16 you had on the launching apparatus 9. Your opponent keeps his blocks 16 and his points.

c) Before placing a block 16 on the launching apparatus 9, you may decide to not place any block 16 on the platform or to place a block 16 of lessor value on the launching apparatus 9 and thus collect less than your optimum points in order not to risk exploding the launching apparatus 9.

CONCLUSIONS, RAMIFICATIONS AND SCOPE OF INVENTION

Thus the reader will see that the apparatus and foam blocks of the invention for toys and games provides a highly reliable, simple and economical device that can be enjoyed by persons of almost any age. While my above description contains many specificities, these should not be construed as limitations on the scope of the invention, but rather as an exemplification of one preferred embodiment thereof. Many other variations are possible. For example, the rigid body members could be "T" shaped in plan view with the extremities securing two elastic cords each along the sides of the rigid body members. The elastic cords could be replaced by BUNGEE cords or metal coil springs. The rigid body members could be made of a rigid plastic, metal, or wood. The blocks or objects stacked upon and thrown by the launching apparatus could be made of inflated impervious plastic fabric shapes or balsa wood as long as they are light in weight and sufficiently compliant to not cause injury to persons upon impact on humans.

Accordingly, the scope of the invention should be determined not by the embodiment(s) illustrated, but by the appended claims and their legal equivalents.

The invention claimed is:

1. A combination game, said combination comprising:

light weight foam blocks used as game objects; and a launching device which utilizes two rigid body members including two flat end end surfaces and having a shape and size held together by the tension force created by an elastic cord pressing together two butting components of the rigid body members in an equilibrium condition until the force from the weight of said game objects placed by the users of the device, or the force from an impulse of said game objects being placed by the users of the device, on the general center area of the device depresses the two flat end surfaces to the extent that a torque is created which causes the extreme ends of the rigid body members and the elastic cord to move rapidly causing the game objects placed by the users to be propelled rapidly away from the launching device.

2. The device of claim 1 wherein multiple elastic cords are used in the launching device.

3. The device of claim 1 wherein the elastic cord used in the launching device is a Bungee cord.

4. The device of claim 1 wherein the game objects placed on the launching device by the users are made of light-weight foam and may be of any shape including, but not restricted to, rectangular solids, triangular solids, blocks with curved surfaces, blocks characterized in the shape of animals, appliances, bombs, aircraft, automobiles.

5. The device of claim 1 wherein the sensitivity to actuation of the launching device can be adjusted when resetting the device by varying the alignment of the two top edges of the butting components on each rigid body member.

* * * * *